US007695113B2

(12) United States Patent
Hirota

(10) Patent No.: US 7,695,113 B2
(45) Date of Patent: Apr. 13, 2010

(54) INK-JET HEAD

(75) Inventor: Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 499 days.

(21) Appl. No.: 11/624,163

(22) Filed: Jan. 17, 2007

(65) Prior Publication Data

US 2007/0165071 A1 Jul. 19, 2007

(30) Foreign Application Priority Data

Jan. 18, 2006 (JP) ..... 2006-009416

(51) Int. Cl.
*B41J 2/045* (2006.01)

(52) U.S. Cl. ..... 347/68; 347/50

(58) Field of Classification Search ..... 347/50, 347/68, 70–72
See application file for complete search history.

(56) References Cited

U.S. PATENT DOCUMENTS 6,685,299 B2 * 2/2004 Hirota ..... 347/20
2005/0083379 A1 4/2005 Chikamoto
2006/0044363 A1 * 3/2006 Katayama ..... 347/71

FOREIGN PATENT DOCUMENTS

EP 1506867 A1 2/2005
JP 2005-059438 A 3/2005

OTHER PUBLICATIONS

European Patent Office, European Search Report for Related Application No. EP 07000830 dated Apr. 18, 2008.

* cited by examiner

*Primary Examiner*—Juanita D Stephens
(74) *Attorney, Agent, or Firm*—Baker Botts L.L.P.

(57) ABSTRACT

An ink-jet head includes two shield plates extending on the surface of the passage unit in a longitudinal direction of the passage unit. Two shield plates confront each other. The surface of the passage unit is provided with two grooves extending up to the middle of the passage unit in a thickness direction of the passage unit. The shield plate is provided at its circumference with a contact line linearly extending and coming into contact with a plane formed on the surface of the passage unit. The shield plate is provided with a projection adjacent to the contact line and protruding from the contact line. The projection is fitted into the groove. The reservoir unit, the actuator unit, and the wiring member are included in a range maintained between the two shield plates with respect to the lateral direction of the passage unit.

12 Claims, 10 Drawing Sheets

INK-JET HEAD

CROSS-REFERENCE TO RELATED APPLICATION

This application claims priority to and the benefit of Japanese Patent Application No. 2006-009416 filed on Jan. 18, 2006, the disclosure of which is incorporated herein by reference.

BACKGROUND OF THE INVENTION

1. Field of the Invention

The present invention relates to an ink-jet head for ejecting ink from an ink ejection port.

2. Description of Related Art

An ink-jet head for ejecting ink from an ink ejection port includes a passage unit, a reservoir unit and an actuator unit. The passage unit has an ink ejection port and a pressure chamber communicating with the ink ejection port. The reservoir unit supplies ink to the passage unit. The actuator unit supplies a pressure to ink in the pressure chamber.

In such ink-jet head as disclosed in Japanese Unexamined Patent Publication No. 2005-59438, the reservoir unit is disposed on the passage unit. On the lower surface of the reservoir unit, the ink discharging ports protrude downward, and the reservoir unit and the passage unit are in contact with each other only at regions surrounding openings of the lower surface of the ink discharging ports. Between the passage unit and the reservoir unit, a gap is formed except areas where the passage unit and reservoir unit are in contact each other. The actuator units are disposed in the gap. Both ends in lateral direction of the reservoir unit are respectively provided with two draw-out grooves recessed inward in lateral direction. A flexible printed circuit (FPC) connected to the upper surface of the actuator unit is draw-out upward through the draw-out groove. In addition, the side face of the reservoir unit is covered with a lower cover. The lower cover is a plate substantially rectangular in shape, under which a convex part is formed that corresponds to the draw-out groove. The lower cover is disposed such that its convex part covers the FPC in the draw-out groove from outside. In the meantime, the lower end of the lower cover other than the convex part and the upper surface of the reservoir unit are brought into close contact with each other. It is therefore prevented ink from being introduced into the ink-jet head. The convex part is formed so as to define a gap between the upper surface of the passage unit, so that the lower end of the convex part does not contact the upper surface. Thus, even though the length of the convex part is slightly raised due to a manufacturing tolerance, the convex part does not contact the upper surface of the passage unit. As a result, it is not prevented the lower end of the lower cover other than the convex part and the upper surface of the reservoir unit from being brought into contact with each other. In addition, configuring the ink-jet head as above, the lower cover is within a width of a head main body in a sub scanning direction (lateral direction) so that the ink-jet head is made smaller.

SUMMARY OF THE INVENTION

In the above-described technique, however, since the gap is formed between the convex part of the lower cover and the upper surface of the passage unit, there is a possibility that ink is introduced into the ink-jet head through the gap. To prevent this, in the ink-jet head disclosed in the document, silicon resin is filled in the gap to seal it to prevent ink from flowing into the ink-jet head. Upon sealing of silicon resin, however, silicon resin is further introduced into the ink-jet head without being stopped in the gap, so that there is a possibility that a unsealed area by silicon resin may be provided in the gap. As a result, there is concern that ink is introduced from the unsealed area of the gap An object of the present invention is to provide an ink-jet head capable of surely preventing ink from being introduced from outside as well as being made compact.

In a first aspect of the present invention, there is provided an ink-jet head including a passage unit, a reservoir unit, an actuator unit, wiring member and two shield plates. The passage unit has a pressure chamber communicating with an ink ejection port formed on an ink ejection face, a common ink chamber communicating with the pressure chamber, and an ink supply port formed on an surface opposite to the ink ejection face. The reservoir unit has an ink reservoir communicating with the ink supply port at the surface of the passage unit where the ink supply port is formed, and storing ink supplied to the common ink chamber. The actuator unit is fixed to the passage unit and provides ink in the pressure chamber with a pressure. The wiring member mounting thereon a driver IC chip that supplies a drive signal to the actuator unit, and is connected to the actuator unit. Two shield plates extend on the surface of the passage unit in a longitudinal direction of the passage unit, and confront each other. The surface of the passage unit is provided with two grooves. Two grooves extend up to the middle of the passage unit in a thickness direction of the passage unit. Two grooves are spaced to a distance equal to a distance between the two shield plates with respect to a lateral direction of the passage unit. The shield plate is provided at its circumference with a contact line. The contact line linearly extends and comes into contact with a plane formed on the surface of the passage unit. The shield plate is provided with a projection adjacent to the contact line and protrudes from the contact line. The projection is fitted into the groove. The reservoir unit, the actuator unit, and the wiring member are included in a range maintained between the two shield plates, with respect to the lateral direction of the passage unit.

According to the invention, with respect to a lateral direction of a passage unit, a reservoir unit, an actuator unit, and a wiring member are disposed such that they are within a range maintained between two shield plates disposed on the surface of the passage unit. Thus, with respect to the lateral direction of the passage unit, the reservoir unit, the actuator unit, and the wiring member are located inner than the both ends of the passage unit. Thus, the ink-jet head comes to be made smaller. In addition, since the surface of the passage unit and a contact line installed on the circumference of the shield plate are in close contact with each other, it is prevented ink (ink mists, for example) from being introduced into the ink-jet head In addition, since a projection is formed adjacent to the contact line and fitted into a groove, even though a gap is provided between the projection and inner wall of the groove. Because, ink is introduced into the ink-jet head only in the case that it is introduced from the outer gap between the projection and the groove to flow to the bottom of the groove and further up to the inner gap between the projection and the groove. Thus, it is in sufficient prevented ink from being introduced into the ink-jet head.

In a second aspect of the invention, there is provided an ink-jet head including a passage unit, a reservoir unit, an actuator unit, a wiring member, and two shield plates. The passage unit has a pressure chamber communicates with an ink ejection port formed on an ink ejection face, a common ink chamber communicating with the pressure chamber, and an ink supply port formed on a surface opposite to the ink ejection face. The reservoir unit has an ink reservoir communicating with the ink supply port at the surface of the passage unit where the ink supply port is formed, and storing ink supplied to the common ink chamber. The actuator unit is fixed to the passage unit and provides ink in the pressure chamber with a pressure. The wiring member mounts thereon a driver IC chip that supplies a drive signal to the actuator unit, and is connected to the actuator unit. Two shield plates extend on the surface of the passage unit in a longitudinal direction of the passage unit, and confront each other. The surface of the passage unit is provided with two grooves extending in the longitudinal direction of the passage unit by the same length of the two shield plates with respect to the longitudinal direction of the passage unit. The grooves extend up to the middle of the passage unit in a thickness direction of the passage unit, and are spaced to a distance equal to a distance between the two shield plates. The shield plate is fitted into the groove. The reservoir unit, the actuator unit, and the wiring member are included in a range maintained between the two shield plates, with respect to the lateral direction of the passage unit.

According to the invention, with respect to a lateral direction of a passage unit, a reservoir unit, an actuator unit, and a wiring member are disposed such that they are within a range maintained between two shield plates disposed on the surface of the passage unit. Thus, with respect to the lateral direction of the passage unit, the reservoir unit, the actuator unit, and the wiring member are located inner than the both ends of the passage unit. Thus, the ink-jet head comes to be made smaller. In addition, since the shield plate is fitted into a groove of the passage unit, it is prevented ink (ink mist, for example) from being introduced into the ink-jet head.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Hereinafter, preferred embodiments of the present invention will be described with reference to the accompanying drawings.

Figure 1:
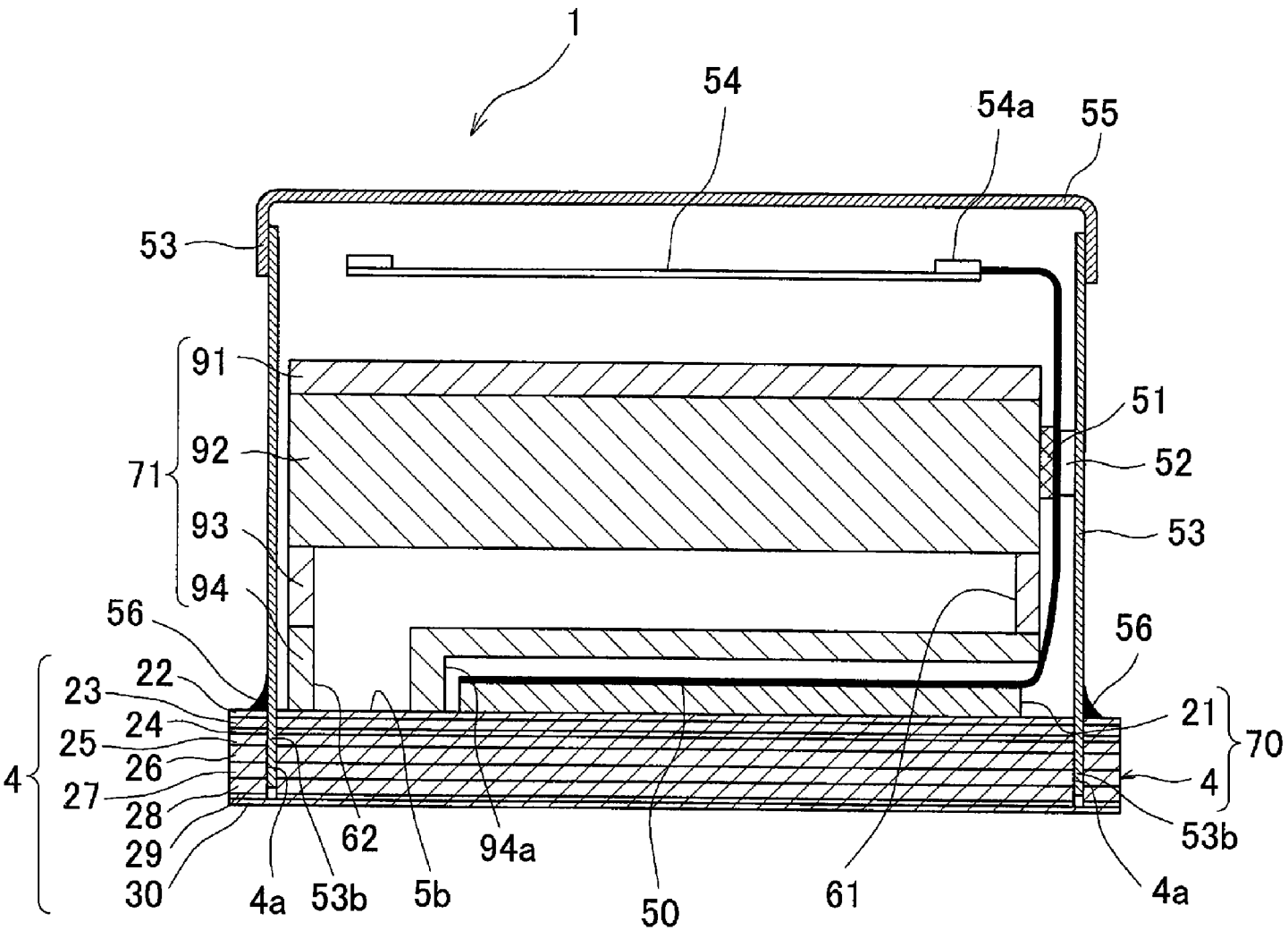
FIG. 1 is a schematic view showing a general construction of an ink-jet head according to an embodiment of the present invention.

FIG. 1 is a schematic view showing a general construction of an ink-jet head according to an embodiment of the present invention. As shown in FIG. 1, the ink-jet head 1 includes a head main body 70, a reservoir unit 71, a Chip On Film (COF, a wiring member) 50, a board 54, two side cover plates (shield plates) 53 and a head cover 55.

The head main body has a passage unit 4 and an actuator unit 21. The reservoir unit 71 is disposed on the upper surface of the head main body 70 to supply ink to the head main body 70. The Chip On Film 50 mounting on its surface a driver IC chip 52 generates drive signals for driving the actuator unit 21 to provide the actuator unit 21 with the drive signal. The board 54 electrically connected with the COF 50. Two side cover plates 53 and a head cover 55 cover the actuator unit 21, the reservoir unit 71, the COF 50, and the board 54 to prevent ink from being introduced from outside.

Figure 2:
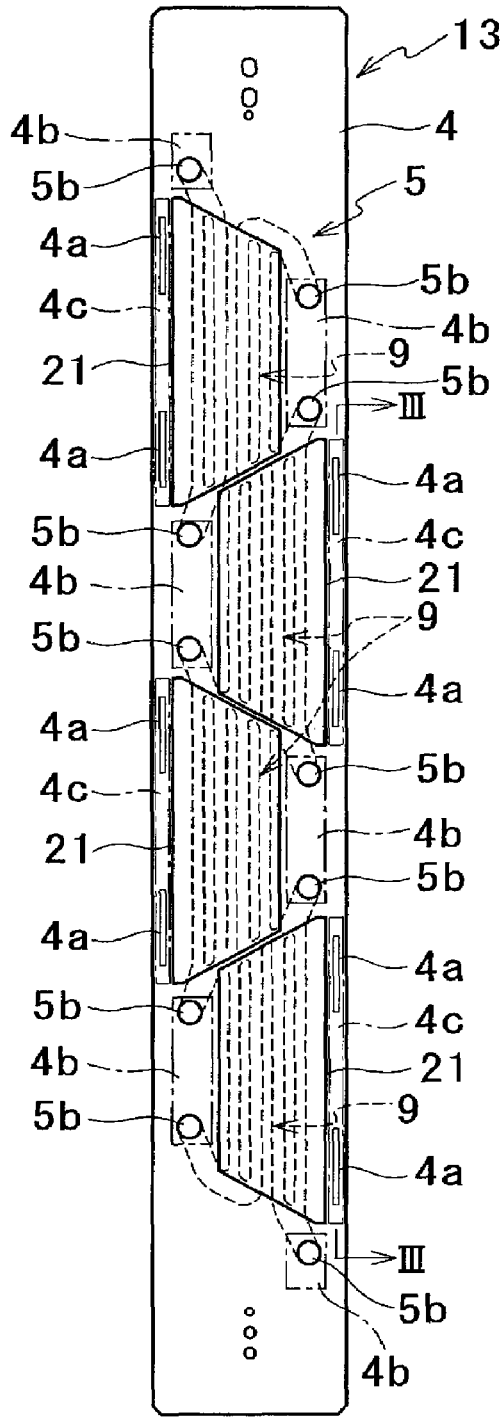
FIG. 2 is a plan view of a main body of the head shown in FIG. 1.

The head main body 70 is constructed such that the actuator unit 21 is disposed on the upper surface of the passage unit 4 with an ink passage formed thereto. The passage unit 4 is provided on its upper surface with ten ink supply ports 5*b* for supplying ink to the ink passage, as shown in FIGS. 1 and 2. FIG. 2 is a plan view of the head main body 70 shown in FIG. 1. The ink supply ports 5*b*, as shown in FIG. 2, are provided on six disposal regions 4*b* for an ink supply port, which are alternatively arranged adjacent to both ends in lateral direction in FIGS. 1 and 2 of the passage unit 4 along a longitudinal direction (vertical direction in FIG. 2) of the passage unit 4. Among six disposal regions 4*b*, two of regions located on opposite ends of the passage unit 4 in its longitudinal direction are respectively provided with one ink supply port 5*b*. The other four regions 4*b* are respectively provided with two ink supply ports 5*b*. In addition, as shown in FIG. 2, the passage unit 4 is provided with eight grooves 4*a* adjacent to both ends in its lateral direction, along its longitudinal direction. Corresponding to the four disposal regions 4*b* for a ink supply port, on which two ink supply ports 5*b* are formed, the eight grooves 4*a* are provided by two on four disposal regions 4*c* for a groove provided adjacent to an end opposite to the end of the surface of the passage unit 4, where the ink supply ports 5*b* are formed, with respect to the lateral direction of the passage unit 4. That is, the eight grooves 4*a* are arranged by four grooves in two rows along the longitudinal direction of the passage unit 4. Herein, near the both ends in the lateral direction of the passage unit 4, the disposal regions 4*b* for an ink supply port and the disposal regions 4*c* for a groove are disposed in zigzags along the longitudinal direction of the passage unit 4. That is, with respect to the lateral direction of the passage unit 4, the ink supply ports 5*b* and the grooves 4*a* are not provided on the same positions. Moreover, with respect to the lateral direction of the passage unit 4, the grooves 4*a*, the lateral side of the reservoir unit 71, and the ink supply ports 5*b* are disposed as to be spaced to each other by turns from outside of the lateral direction. Thus, the grooves 4*a* and the ink supply ports 5*b* are not arranged in the same line. Thus, the passage unit 4 is preventing from being degraded its stiffness extremely. In addition, as will be described later, the COF 50 is easily drawn up through passing it through an inter-space between the side cover plate 53 disposed just above the grooves 4*a* and the lateral side face of the reservoir unit 71.

The reservoir unit 71 is disposed on the upper surface of the head main body 70. The reservoir unit 71, as will be described later, supplies ink to the passage unit 4 from through-holes 62 communicating with the ink supply ports 5*b* provided on the upper surface of the passage unit 4. A width of the reservoir unit 71 is smaller than that of the passage unit 4, and positioned inner than the grooves 4*a* in a lateral direction in FIG. 1.

The vicinity of one end of the COF 50 is adhered to the upper surface of the actuator unit 21. Thus, a wiring (not shown) formed on the surface of the COF 50 is electrically connected to individual electrodes 35 and a common electrode 34 described later. In addition, it sends drive signals generated by the driver IC chip 52 mounted thereon to the individual electrodes 35 and the common electrode 34 through the wiring. Moreover, the COF 50 is drawn-out upward between the side cover plate 53 and the reservoir unit 71, and the other end thereof is connected to the board 54 by a connector 54*a*.

Figure 3:
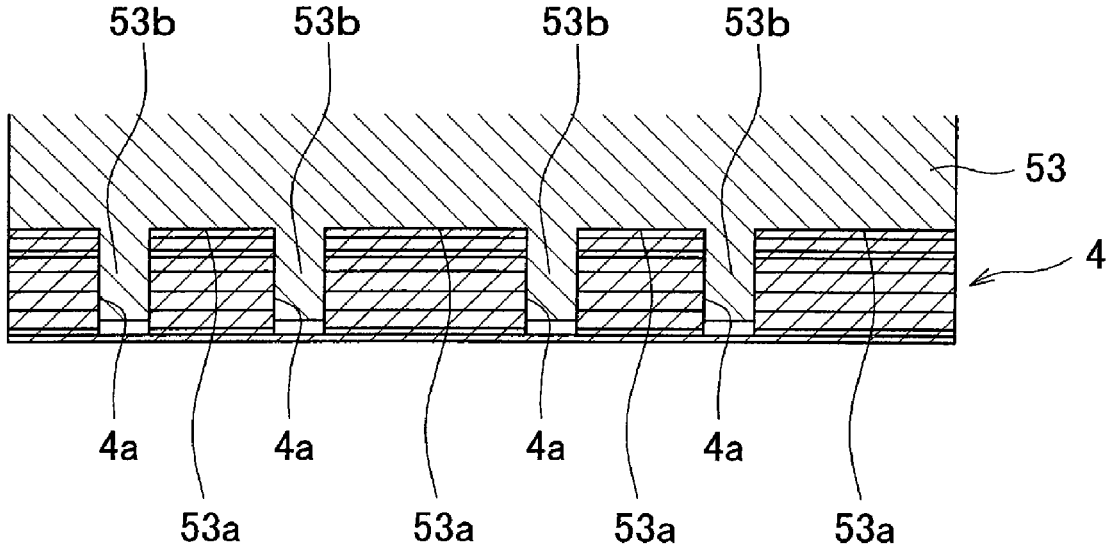
FIG. 3 is a cross sectional view taken along lines III-III in FIG. 2.

The side cover plates 53 are substantially rectangular plate made of metallic material. The side cover plates 53 extend in a longitudinal direction of the passage unit 4, together with the vertical direction in FIG. 1. The lower end of the side cover plates 53 constituting the circumference of the side cover plates 53, as shown in FIGS. 1 and 3, are provided thereon with some contact lines 53*a* contacting the planer upper surface of the passage unit 4. In addition, the side cover plates 53 are provided with eight projections 53*b*, which extends downward corresponding to the grooves 4*a* from the areas between the contact lines 53*a*. Each area is adjacent to the contact line 53*a*. The projections 53*b* are fitted into the corresponding grooves 4*a*. FIG. 3 is a cross sectional view taken along the lines III-III in FIG. 2. The side cover plates 53 are fixed to the passage unit 4 by fitting the projections 53*b* into the grooves 4*a* formed adjacent to both ends in lateral direction of the passage unit 4. Thus, the contact lines 53*a* and the upper surface of the passage unit 4 come into contact each other, so that it is prevented ink (ink mist, for example) from being introduced into the ink-jet head 1.

In addition, a distance between the two side cover plates 53 is smaller than the width of the passage unit 4. Further, with respect to the lateral direction of the passage unit 4, the lengths of the side cover plates 53 and the projections 53*b* are similar to that of the grooves 4*a*, and with respect to the longitudinal direction of the passage unit 4, the length of the projections 53*b* is similar to that of the grooves 4*a*.

Accordingly, there is no gap between the side cover plates 53 and the grooves 4*a*, so that there is no case where ink is introduced into the ink-jet head 1. In addition, even though there is slight gaps between the projections 53*b* and the grooves 4*a*, since the projections 53*b* are formed adjacent to the contact lines 53*a* are fitted into the grooves 4*a* , it is sufficiently prevented ink from being introduced into the ink-jet head 1. Because ink is introduced only in the case that it is introduced from the outer gaps between the projections 53*b* and the grooves 4*a* to flow to the bottom of the grooves 4*a* and further to the inner gaps between the projections 53*b* and the grooves 4*a*.

In addition, when the projections 53*b* are fitted into the grooves 4*a*, gaps are formed between the lower end of the projections 53*b* and the bottom of the grooves 4*a*. Thus, even though the length of the projections 53*b* is varied due to a manufacturing tolerance, there is no case where the lower end of the projections 53*b* come to contact with the bottom of the grooves 4*a*, and the contact lines 53*a* surely come to contact with the upper surface of the passage unit 4.

As shown in FIG. 1, a sealing member 56 composed of silicon resin or others is applied to extend across the outer side face of the side cover plates 53 and the upper surface of the passage unit 4. Thus, even though there is one or more slight gaps between the side cover plates 53 and the upper surface of the passage unit 4 due to the manufacturing tolerance, they are then filled by the sealing member 56. In addition, the side cover plates 53 are securely fixed to the passage unit 4 by the sealing member 56. Herein, since the contact lines 53*a* of the side cover plates 53 and the upper surface of the passage unit 4 are in close contact with each other, upon application of the sealing member 56, the sealing member 56 is not easily introduced into the ink-jet head 1, the sealing member 56 is surely applied the area where the side cover plates 53 and the passage unit 4 are in contact with each other.

In addition, two side cover plates 53 extend along the substantially overall longitudinal length of the passage unit 4 near both lateral ends of the passage unit 4. With respect to the vertical direction, they extend up to a level over the reservoir unit 71 and the board 54. Thus, the reservoir unit 71, the COF 50, and the board 54 are disposed between the two side cover plates 53. That is, the width of the reservoir unit 71 comes to be smaller than a distance between the two shield plates. Thus, the reservoir unit 4, the COF 50, and the board 54 do not come to be positioned outside from the end of the passage unit 4 with respect to the lateral direction of the passage unit 4. The head cover 55 is composed of the same material as the side cover plates 53, and is disposed so as to cover a portion near the upper ends of the two side cover plates 53 above the two side cover plates 53. In addition, the head cover 55 covers both longitudinal ends of the passage unit 4. The reservoir unit 71, the COF 50, and the board 54 are disposed in a space defined by the two side cover plates 53 and the head cover 55. In addition, as shown in FIG. 1, the sealing member 56 is also applied to the fitting portion between the side cover plates 53 and the head cover 55 from outside to thereby more securely prevent intrusion of ink from outside.

Figure 4:
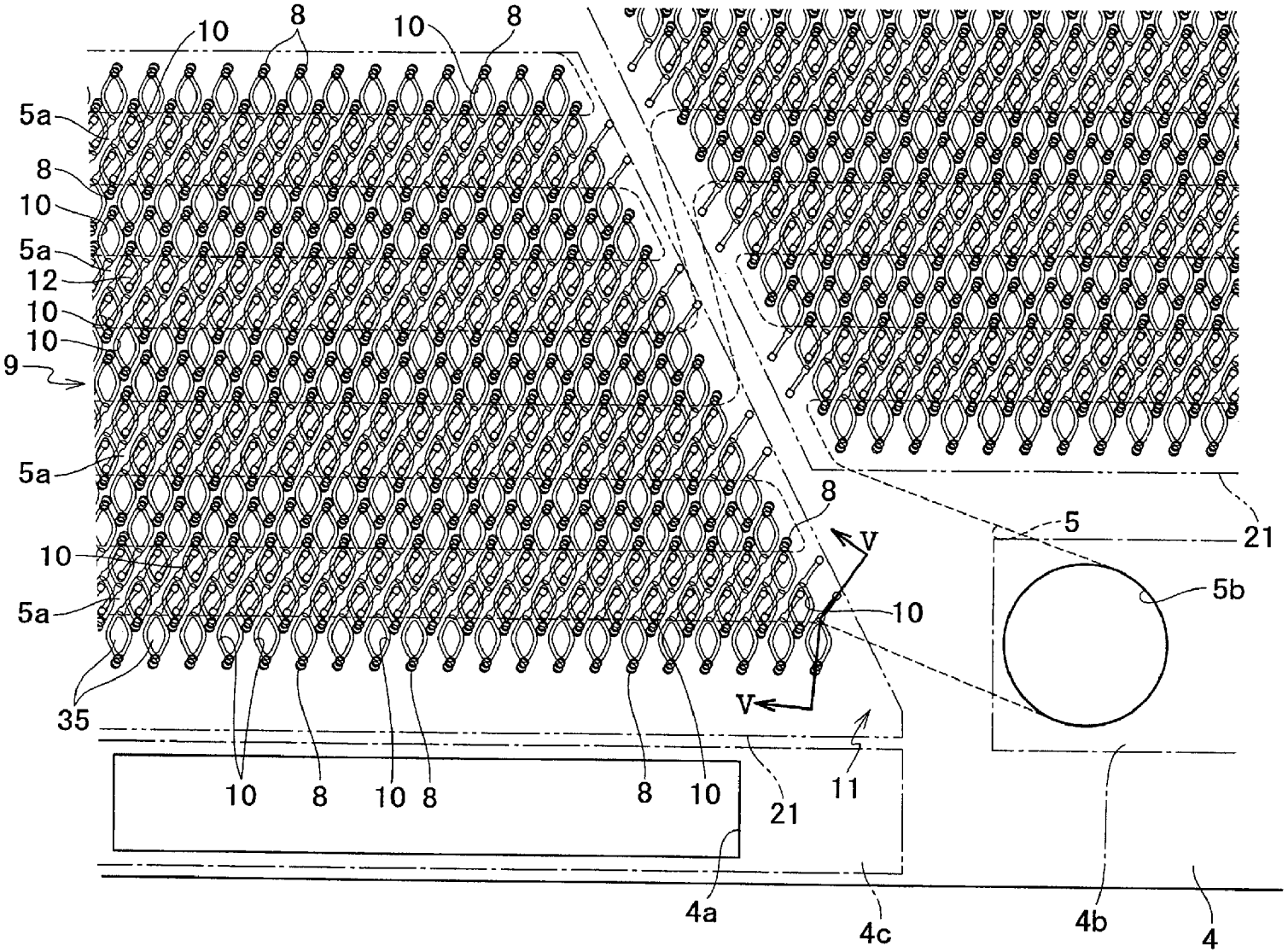
FIG. 4 is a partially enlarged view of FIG. 3.

Next, the head main body 70 will now be explained referring to FIGS. 2 and 4. FIG. 4 is an enlarged plan view of an area indicated by a dashed dotted line in FIG. 2. As shown in FIGS. 2 and 4, the head main body 70 includes four pressure chamber groups 9 composed of many pressure chambers 10, and the passage unit 4 having many nozzles 8 communicated with respective pressure chambers 10. Four trapezoidal actuator units 21 are adhered on the surface of the passage unit 4. These trapezoidal actuator units 21 are arranged in two rows in zigzags. Specifically, the actuator units 21 are respectively disposed such that its parallel sides (upper and lower sides) follow the longitudinal direction of the passage unit 4. In addition, the oblique sides of the adjacent actuator units 21 are overlapped among themselves in the lateral direction of the passage unit 4.

The lower surface of the passage unit 4 opposite to the adhesive region of the actuator units 21 forms an ink ejection areas. As shown in FIG. 4, many nozzles 8 are regularly arranged on the surface of the ink ejection areas respectively.

In the passage unit 4, manifold passages 5 and sub-manifold passages 5*a* of branch passages thereof are formed as common ink chambers. The manifold passages 5 extend to follow the oblique sides of the actuator unit 4, and are disposed, intersecting with the longitudinal direction of the passage unit 4. In the center of the passage unit 4, the manifold passages 5 are shared with the actuator units 21 adjacent thereto, respectively. The sub-manifold passages 5*a* branch off from the opposite sides of the manifold passages 5. In addition, as described before, to the manifold passages 5, ink is supplied from the ink supply ports 5*b* formed on the passage unit 4, and is then distributed to the respective ink passages.

The respective nozzles 8 communicate with the sub-manifold passages 5*a* through the pressure chambers 10 that is shaped like a rhombus in plan view and apertures 12 acting as a throttle. Inside the passage unit 4, a number of individual ink passages 32 are formed from an outlet of the sub-manifold passages 5*a* to the corresponding nozzles 8 via the pressure chambers 10. In addition, in FIGS. 2 and 4, for easy understanding of the drawings, the actuator units 21 are depicted by a dashed dotted line, and the pressure chambers 10 and the apertures 12 that are below the actuator units 21 and are to be depicted by a broken line are indicated by a solid line.

Figure 5:
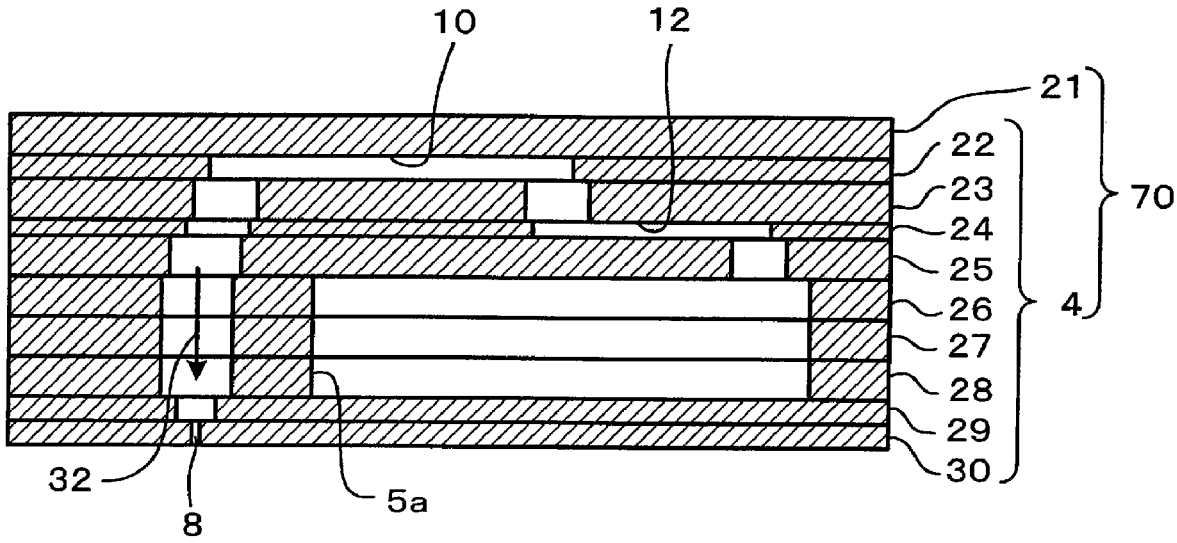
FIG. 5 is a cross sectional view taken along lines V-V in FIG. 4.

Description will be made to a cross sectional structure of the head main body 70 referring to FIGS. 1 and 5. FIG. 5 is a cross sectional view taken along the lines V-V in FIG. 4. As shown in FIGS. 1 and 5, the head main body 70 is formed by attaching the passage unit 4 and the actuator unit 21 each other. The passage unit 4, as described before, has a laminated structure in which a cavity plate 22, a base plate 23, an aperture plate 24, a supply plate 25, three manifold plates 26, 27, and 28, a cover plate 29, and a nozzle plate 30 are laminated in order from upside.

The cavity plate 22 is a metal plate that has a number of substantially rhombus through-holes constituting the pressure chambers 10, and eight through-holes constituting portions of the grooves 4*a*. The base plate 23 is a metal plate that has a number of through-holes for communicating the respective pressure chambers 10 and the apertures 12 corresponding thereto with each other, a number of through-holes for communicating the respective pressure chambers 10 and the nozzles 8 corresponding thereto with each other, and eight through-holes constituting portions of the grooves 4*a*. The aperture plate 24 is a metal plate that has a number of through-holes constituting the apertures 12, through-holes for communicating the respective pressure chambers 10 and the nozzles 8 corresponding thereto with each other, and eight through-holes constituting portions of the grooves 4*a*. The supply plate 25 is a metal plate that has a number of through-holes for communicating the respective apertures 12 and the sub-manifold passages 5*a* with each other, a number of through-holes for communicating the respective pressure chambers 10 and the nozzles 8 corresponding thereto with each other, and eight through-holes constituting portions of the grooves 4*a*. Each of the three manifold plates 26, 27, and 28 is a metal plate that has a number of through-holes constituting the manifold passages 5*a*, a number of through-holes for communicating the respective pressure chambers 10, and the nozzles 8 corresponding thereto with each other, and eight through-holes constituting portions of the grooves 4*a*. The cover plate 29 is a metal plate that has a number of through-holes for communicating the respective pressure chambers 10 and the nozzles 8 corresponding thereto with each other, and eight through-holes constituting portions of the grooves 4*a*. The nozzle plate 30 is a metal plate that has a number of nozzles 8.

These nine plates are laminated, being lined up with each other to thereby form the individual ink passages 32. Herein, by the through-holes constituting the portions of the grooves 4*a* formed on the eight plates 22 to 29, and the upper surface of the nozzle plate 30, the grooves 4*a* are defined. In this way, the grooves 4*a* are defined by forming the through-holes on the eight plates 22 to 29 except the nozzle plate 30, so that the grooves 4*a* extend from the surface of the passage unit 4 to some extent in its thickness direction that it, however, does not reach the lower surface of the nozzle plate 30. Thus, it is possible to deepen the grooves 4*a* to the maximum with preventing ink applied to the lower surface of the nozzle plate 30 from being introduced toward the upper surface of the passage unit 4 via the grooves 4*a*.

Figure 6A:
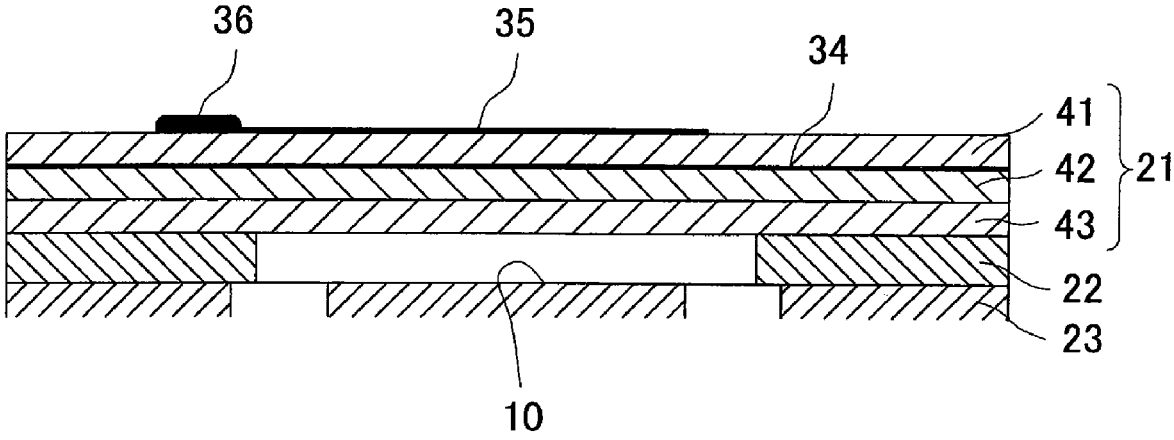
FIG. 6A is an enlarged view of an area near an actuator unit shown in FIG. 5.

FIG. 6A is an enlarged view of an area near the actuator unit shown in FIG. 5. As shown in FIG. 6A, the actuator units 21 have a laminated structure in which three piezoelectric sheets 41, 42, and 43 are piled up on one another. Each of three piezoelectric sheets 41 to 43 has a thickness of approximately 15 μm, and the actuator units 21 has a thickness of approximately 45 μm. All of piezoelectric sheets 41 to 43 are formed with continuous layered flat plates so as to be disposed throughout the pressure chambers 10 formed in ink ejection areas in the head main body 13. In this way, in one laminated structure, the structure as shown in FIG. 6A is embodied for each pressure chamber 10, so that the actuator units 21 are configured. The piezoelectric sheets 41 to 43 are composed of ferroelectric Piezoelectric Zicronate Titanate(PZT) based ceramics.

Figure 6B:
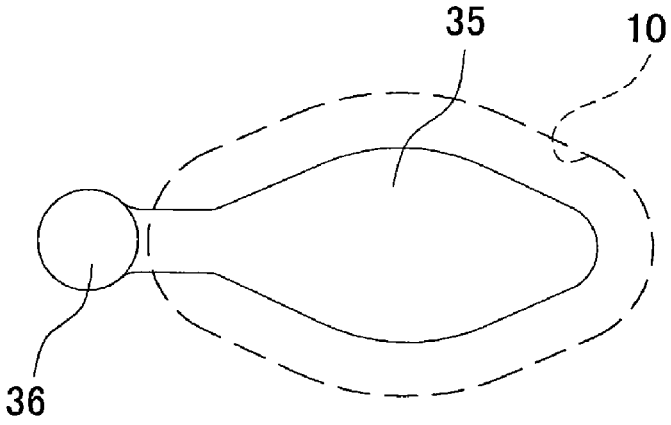
FIG. 6B is a plan view of an individual electrode shown in FIG. 6A.

On the uppermost piezoelectric sheet 41, individual electrodes 35 each having thickness of approximately 1 μm are formed. The individual electrodes 35 and the common electrode 34 to be described later are composed of conductive material, such as metal, for example. The individual electrodes 35 are, as shown in FIG. 6B, shaped like a rhombus in plan view, and are formed such that it mostly overlaps with the pressure chambers 10 and are mostly contained in the pressure chambers 10 as viewed from a plane. FIG. 6B is a plan view of the individual electrode 35 and a land 36 shown in FIG. 6A. In addition, as shown in FIG. 3, on the uppermost piezoelectric sheet 41, a number of individual electrodes 35 are regularly arranged in two-dimension across substantially overall area of the sheet. In the present embodiment, since the individual electrodes 35 are formed only on the surface of the actuator unit 21, only the piezoelectric sheet 41 that is the outermost layer of the actuator unit 21 includes an active layer. Thus, the actuator unit 21 is an uni-morph type actuator.

An acute angled part of the individual electrodes 35 adjacent to the long side of the actuator unit 21 extends above girders of cavity plate 21. The girders are adhered to the actuator unit 21 and support the actuator units 21. Further, the lands 36 are formed near the leading ends of the extension. The lands 36, as shown in FIG. 6B, have a substantially circular shape in plan view, and a thickness of approximately 15 μm. The lands 36 are composed of conductive material like the individual electrodes 35 and the common electrode 34, and the individual electrodes 35 and the lands 36 are electrically connected each other.

Between the uppermost piezoelectric sheet 41 and the next piezoelectric sheet 42, the common electrode 34 in thickness of approximately 2 μm is disposed on the whole of the sheet. Thus, the piezoelectric sheet 41 that overlaps with the pressure chambers 10 is sandwiched by the individual electrodes 35 and the common electrode 34 at each place overlapping with the pressure chambers 10. No electrodes are disposed between the two piezoelectric sheets 42 and 43.

The common electrode 34 is grounded at a region not shown. Thus, the common electrode 34 is kept at ground potential in its portion corresponding to all pressure chambers 10. The individual electrodes 35, as will be described later, are respectively electrically connected to the driver IC chip 52 through the wiring (not shown) of the COF 50.

On the upper surface of the actuator unit 21, as shown in FIG. 1, the COF 50 is disposed. The COF 50 is adhered, at the vicinity of one end thereof, to the upper surface of the actuator unit 21 at the vicinity of one end. Thus, the wiring formed on the surface thereof is connected to the actuator unit 21. Further, the COF 50 extends substantially upward through the inter-space between the reservoir unit 71 and the side cover plate 53 from near right end of the upper surface of the actuator unit 21. In the middle of the upward extension of the COF 50, the driver IC chip 52 is disposed on the right side of the COF 50 shown in FIG. 1. The driver IC chip 52 is in contact at its side cover plate 53 at its side surface confronting the side cover plate 53, through a sheet type heat-conductive member. Thus, the driver IC chip 52 and the side cover plate 53 are thermally coupled. Since the side cover plates 53 are composed of metal, heat generated by the driver IC chip 52 is transferred to the side cover plate 53, being discharged outside efficiently. Herein, since the side cover plates 53 are disposed outermost with respect to the lateral direction of the ink-jet head 1, it is possible to more effectively discharge heat. On opposite surface of the COF 50 to the surface where the driver IC chip 52 is formed, a sponge 51 is disposed. The opposite surface of the sponge 51 to the COF 50 is fixed to the side face of the filter plate 92 constituting the reservoir unit 71. The sponge 51 presses the driver IC chip 52 against the side cover plates 53 using elastic force thereof. Thus, the driver IC chip 52 and the side cover plates 53 come into close contact with each other to thereby improve a thermal coupling characteristic.

Here, an operation of the actuator units 21 will be explained. In the actuator units 2, only the piezoelectric sheet 41 among three sheets 41 to 43 is polarized in a direction from the individual electrodes 35 toward the common electrode 34. When a certain electric potential is applied to the individual electrodes 35 by the driver IC chip 52, there is an electric potential difference in a region (active layer) between the one or more individual electrodes 35, to which a certain potential is applied, and the common electrode 34 kept at ground potential in the piezoelectric sheet 41. Thus, in that portion of the piezoelectric sheet 41, electric fields are generated in its thickness direction, and the regions of the piezoelectric sheet 41 are reduced in a direction perpendicular to the polarization direction by a transversal piezoelectric effect. The other piezoelectric sheets 42 and 43 are not reduced by themselves as such because an electric fields are not applied thereto. Thus, in the regions of the piezoelectric sheets 41 to 43 overlapping with the active layer, uni-morph deformation protruding toward the pressure chamber 10 occurs. Then, volume of the pressure chambers 10 are reduced to increase ink pressure to eject ink from the nozzles 8 shown in FIG. 4. When the individual electrodes 35 then returns to a ground potential, the piezoelectric sheets 41 to 43 return to their original shape, and the pressure chambers 10 also return to its original volume. Thus, ink is sucked from the sub-manifold passages 5*a* to the individual ink passages 32.

Figure 7A:
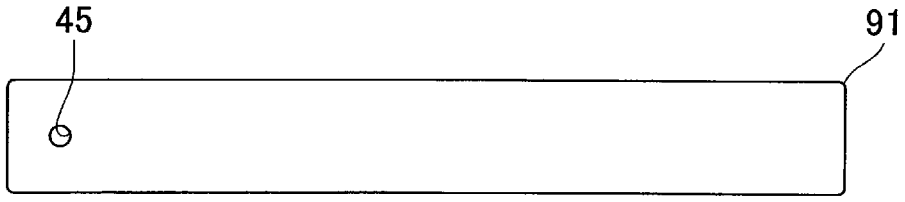
FIG. 7A is a plan view of an upper plate constituting a reservoir unit shown in FIG. 1.
Figure 7B:
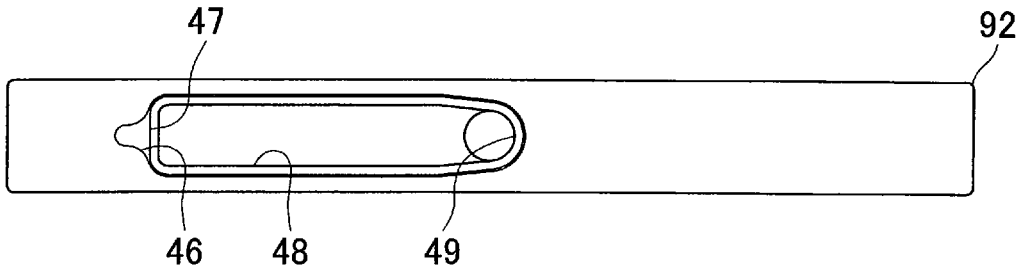
FIG. 7B is a plan view of a filter plate constituting a reservoir unit shown in FIG. 1.
Figure 7C:
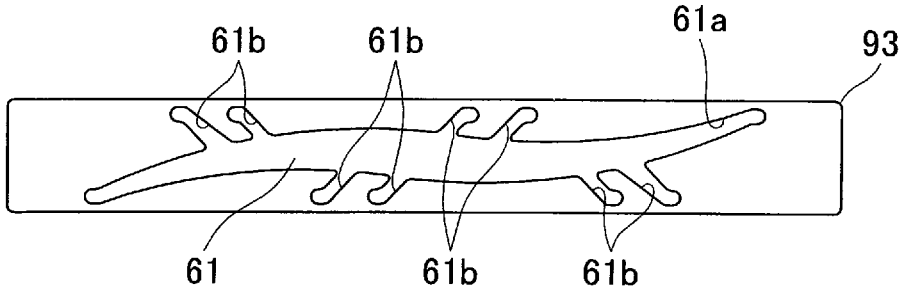
FIG. 7C is a plan view of a reservoir plate constituting a reservoir unit shown in FIG. 1.
Figure 7D:
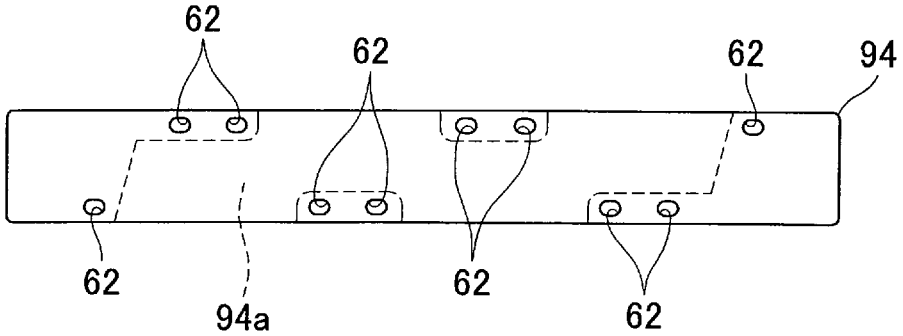
FIG. 7D is a plan view of a under plate constituting a reservoir unit shown in FIG. 1.
Figure 8:
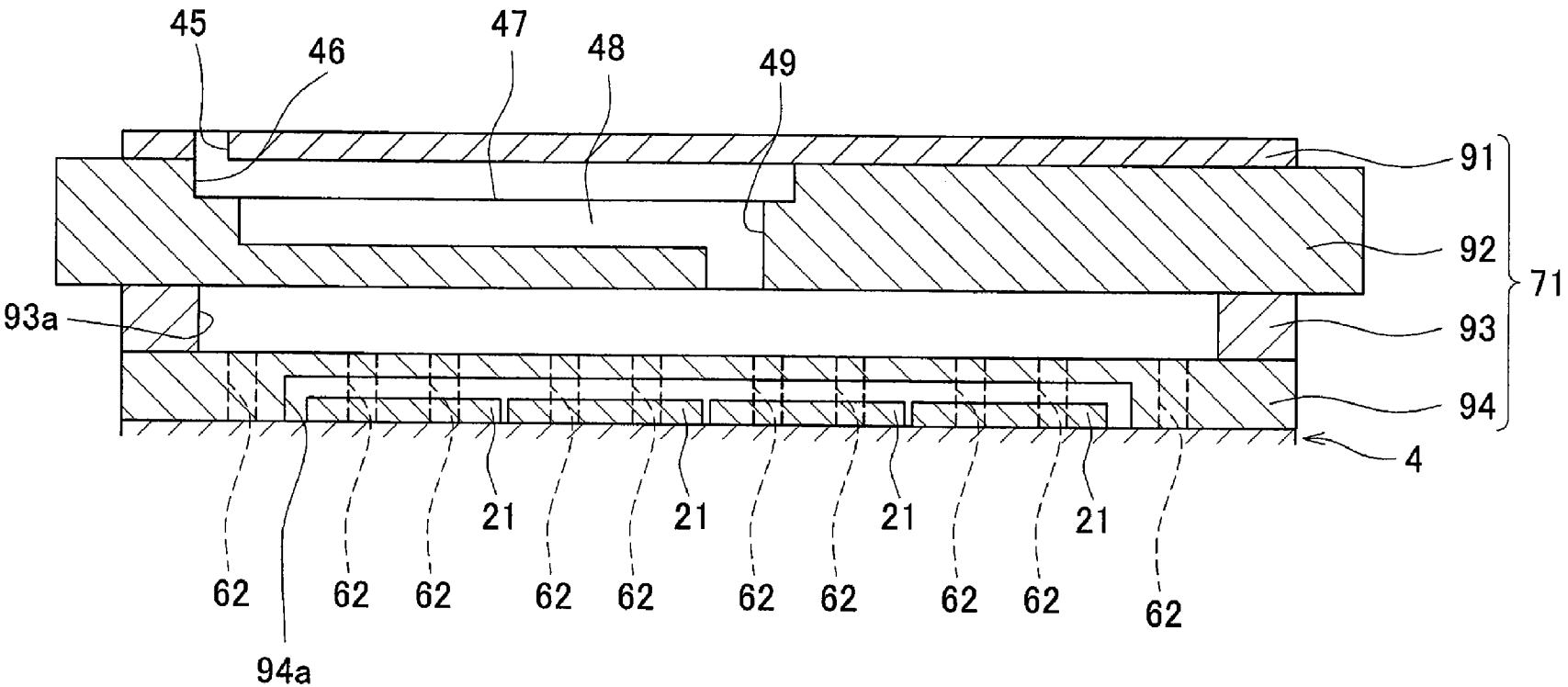
FIG. 8 is a longitudinally sectional view showing four plates shown in FIGS. 7A to 7D, which are piled up on one another.

Next, the reservoir unit 71 is explained referring to FIGS. 7A to 7D, and 8. FIGS. 7A to 7D are plan views of four plates constituting the reservoir unit shown in FIG. 1, wherein FIG. 7A illustrates an upper plate 91, FIG. 7B illustrates a filter plate 92, FIG. 7C illustrates a reservoir plate 93, and FIG. 7D illustrates a under plate 94. FIG. 8 is a longitudinally sectional view of four plates 91 to 94 shown in FIGS. 7A to 7D, which are laminated.

The reservoir unit 71 is constructed, as shown in FIG. 8, by piling up the upper plate 91, the filter plate 92, the reservoir plate 93, and the under plate 94 each other from upside. These four plates 91 to 94 are substantially rectangular flat plates having the same longitudinal direction as that of the passage unit 4. In addition, the widths of these four plates 91 to 94, as shown in FIG. 1, are shorter than a distance between the two side plates 53. The upper plate 91, as shown in FIGS. 7A and 8, is provided with an through-hole 45 near the left end (FIG. 8). Ink is supplied through the through-hole 45 from an ink tank not shown.

The filter plate 92, as shown in FIGS. 7B and 8, is provided with a hole 46 having a depth corresponding to approximately ⅓ thickness of the filter plate 92 from the upper surface thereof. The hole 46 extends from a region of the filter plate 92 overlapping with the opening 45 to the substantially central region of it in the longitudinal direction of the filter plate 92, and communicates with the through-hole 45 near the left end in FIG. 8. Under the hole 46, a filter 47 is disposed throughout.

Under the hole 46, a hole 48 is formed to have a depth corresponding to approximately ⅓ thickness of the filter plate 92, interposing the filter 47 therebetween. The hole 48 has a shape in plan view much smaller than that of the hole 46. Below the hole 48, a hole 49 is formed overlapping with the right end (FIG. 9) in the longitudinal direction of the hole 48. The hole 49 has a depth of approximately ⅓ thickness of the filter plate 92, and is opened at the lower surface of the filter plate 92. The hole 48 communicates with a hole 61 to be described, through the hole 49.

The reservoir plate 93, as shown in FIGS. 7C and 8, is provided with the hole 61. The hole 61 consists of a main passage 61*a* extending along the middle section of the reservoir plate 93 in its longitudinal direction, and eight branch passages 61*b* branched in the middle of the main passage 61*a*. The main passage 61*a* is bent downward in the left side in FIG. 7C and bent upward in the right side of in FIG. 7C. Both end of the main passage 61*a* overlap with through-holes 62 closely proximate to both longitudinal ends of the under plate 94, among ten through-holes 62 formed on the under plate 94. In addition, the eight branch passages 61*b* extend up to a position overlapping with the remaining eight through-holes 62. Herein, the hole 61 comes to be an ink reservoir for storing ink.

The under plate 94 is provided with ten through-holes 62 that are substantially circular in planar shape, and communicate with the hole 61. The through-holes 62 are formed near both lateral ends of the under plate 94, corresponding to the ink supply ports 5*b* of the passage unit 4. In addition, on an under face of the under plate 94, other than near both longitudinal ends and the region where the through-holes 62 are formed, a recess 94*a* is formed, a thickness of which is thinner than those portions. The reservoir unit 71 is fixed to the passage unit 4 by those portions, i.e., near both longitudinal ends and the regions where the through-holes 62 are formed. Herein, a gap is defined between the passage unit 4 and the portion of the under plate 94 where the recess 94*a* is formed. In the gap, the actuator unit 21 is adhered to the surface of the passage unit 4 through a slight gap between the under plate 94. In addition, this gap is opened between the formation regions of through-holes 62 adjacent in the longitudinal direction of the under plate 94 at the lateral end of the under plate 94.

Further, in the reservoir unit 71, the through-hole 45 communicates with the through-holes 62 through the hole 46, the filter 47, the hole 48, and the hole 61. Thus, ink supplied from the ink tank to the through-hole 45 flows to the through-holes 62, and is supplied to the passage unit 4 from the ink supply ports 5*b* communicating with the through-holes 62.

According to the embodiments described before, the projections 53*b* of the side cover plate 53 are fittingly lined up into the grooves 4*a* of the passage unit 4, so that the contact lines 53*a* of the side cover plate 53 come into close contact with the upper surface of the passage unit 4, thereby preventing ink from being introduced into the ink-jet head 1.

In addition, since the projections 53*b* are formed adjacent to the contact lines 53*a* and are fitted into the grooves 4*a*, even though there is gaps between the projections 53*b* and the grooves 4*a*, it is sufficiently prevented ink from being introduced into the ink-jet head 1. Because ink is introduced only in the case that it is introduced from the outer gaps between the projections 53*b* and the grooves 4*a* to flow to the bottom of the grooves 4*a* and further to the inner gaps between the projections 53*b* and the grooves 4*a*.

In addition, the distance between the two side cover plates 53 is shorter than the width of the passage unit 4, the width of the reservoir unit 71 is shorter than the distance between the two side cover plates 53, and the reservoir unit 4, the actuator unit 21, the COF 50, and the board 54 are positioned between the two side cover plates 53. Thus, it is possible to make the ink-jet head 1 smaller.

In addition, Since the passage unit 4 is provided with the grooves 4*a*, and the side cover plates 53 is provided with the projections 53*b* corresponding to the grooves 4*a*, it is possible to securely fix the side cover plates 53 to the passage unit 4.

In addition, if the ink supply ports 5*b* and the grooves 4*a* are formed on the same lateral ends, they need to be separated sufficiently so as to prevent them from being connected to each other due to a manufacturing tolerance. In this case, the passage unit 4 comes to be larger. In the present embodiments, however, the ink supply ports 5*b* and the grooves 4*a* are formed near opposite ends to each other with respect to the lateral direction of the passage unit 4, so that both are sufficiently separated. Thus, it is possible to minimize the ink-jet head. In addition, with respect to the longitudinal direction of the passage unit 4 near both lateral ends of the passage unit 4, the disposal regions 4*c* for groove 4*a* and the disposal regions 4*b* for the ink supply port 5*b* are disposed in zigzags, and the grooves 4*a* and the ink supply ports 5*b* are not arranged in a straight line. Thus, the passage unit 4 maintains high stiffness. In addition, with respect to the lateral direction of the passage unit 4, the grooves 4*a*, the lateral side face of the reservoir unit 71, and the ink supply ports 5*b* are serially disposed from outside to a distance with each other. Thus, the COF 50 is disposed so as to pass through an inter-space between the side cover plate 53 and the reservoir unit 71, it is possible to draw-out the COF 50 upward with ease.

In addition, the grooves 4*a* are defined by the through-holes formed on eight plates 22 to 29 except the nozzle plate 30 constituting the passage unit 4, and the upper surface of the nozzle plate 30, and does not extend up to the lower surface of the nozzle plate 30. Thus, there is no case where ink applied to the lower surface of the nozzle plate 30 is introduced toward the upper surface of the passage unit 4 through the grooves 4*a*. In addition, the grooves 4*a* are formed to be deepened to the maximum, upon fitting the projections 53*b* into the grooves 4*a*, the side cover plates 53 are securely fixed to the passage unit 4.

In addition, since the sealing member 56 is applied to extend across outer lateral side of the side cover plate 53 and the surface of the passage unit 4, even though there is a slight gap between the side cover plate 53 and the passage unit 4, the gap is securely sealed. Thus, it is securely prevented ink from being introduced from outside to inside of the side cover plate 53. Herein, since the contact lines 53*a* of the side cover plates 53 and the upper surface of the passage unit 4 come into close contact with each other, the sealing member 56 is hardly introduced into the ink-jet head. Thus, the sealing member 56 is surely applied the area where the side cover plates 53 and the passage unit 4 are in contact with each other.

In addition, since the side cover plates 53 are composed of metal, and the driver IC chip 52 and the side cover plates 53 are in close contact with each other, it is possible to effectively discharge heat generated from the driver IC chip 52 outside. Further, since the side cover plates 53 are disposed outermost from the ink-jet head 1, it is possible to effectively discharge heat. In addition, it is possible to reduce the number of the parts because it needs not to install another heat sink.

Next, description will be made to modifications of the present embodiment. In the modifications, the same members as in the above embodiment will be devoted by the same reference numerals, and the detailed description thereof will be properly omitted.

Figure 9A:
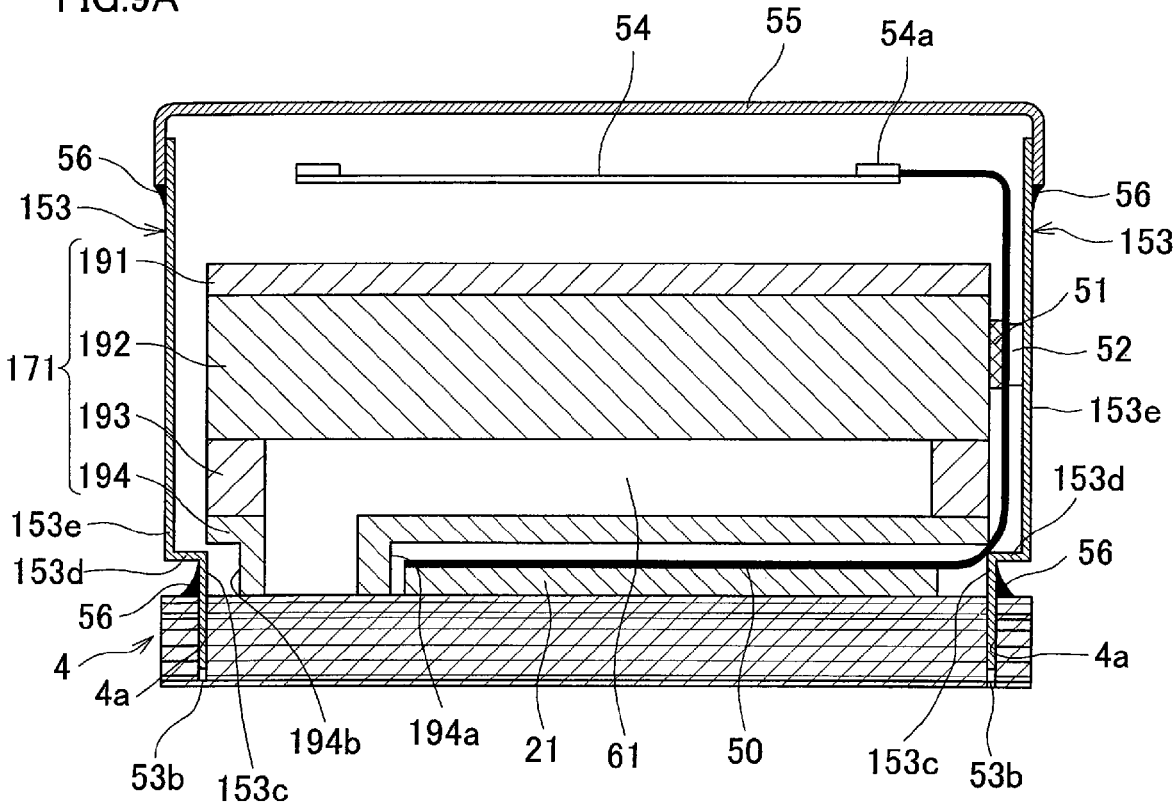
FIG. 9A is a schematic view showing a general construction of an ink-jet head according to a modified embodiment, which is similar to FIG. 1.

In a modification, as shown in FIG. 9A, two side cover plates 153 include a first vertical wall 153*c*, an opposed wall 153*d* and a second vertical wall 153*e*, respectively. The first vertical wall 153*c* extends upward from the contact lines 53*a* (See FIG. 3) to a level higher than the upper surface of the actuator unit 21. The opposed wall 153*d* extends substantially parallel to the upper surface of the passage unit 4 to the outside of the passage unit 4 in the lateral direction of passage unit 4 from the upper end of the first vertical wall 153*c*, and overlapped with the upper surface of the passage unit 4. The second vertical wall 153*e* extends upward from the outer end of the opposed wall 153*d* in a direction away from the upper surface of the passage unit 4.

The first vertical wall 153*a*, the opposed wall 153*d*, and the second vertical wall 153*e*, similar to the side cover plate 53 in the above embodiment, extend along the longitudinal direction of the passage unit 4. The COF 50 comes into contact with a corner connecting the first vertical wall 153*a* and the opposed wall 153*d* each other. The COF 50 also comes into contact with a corner of an under plate 194, which partially defines the opening of the gap formed by a recess 194*a* and the passage unit 4.

In this case, a distance between two of the second vertical walls 153*e* is longer than that of two of the first vertical walls 153*c*. Thus, it is possible to elongate widths of a upper plate 191, a filter plate 192, a reservoir plate 193, and the under plate 194, which constitute a reservoir unit 171. Herein, the under plate 194 is provided with a recess 194*b* near the left end of FIG. 9A, in addition to the same recess 194*a* as that of the above embodiment. Thus, the reservoir unit 171 does not come into contact with the first vertical wall 153*c*. In addition, in this modification, the distance between two of the second vertical walls 153*e* is made substantially equal to the width of the passage unit 4. Thus, when some ink-jet heads are installed, the set of the heads do not come to be large extremely. In addition, the space defined by the first vertical wall 153*c*, the opposed wall 153*d*, and the surface of the passage unit 4 outer than the first vertical wall 153*c* serves as a guide when the sealing member 56 is applied by a dispenser for example. Thus, it is possible to properly carry out the application of the sealing member 56.

In this case, the COF 50 comes into contact with the corner between the first vertical wall 153*c* and the opposed wall 153*d*, and the end of the under plate 94. Thus, even though ink is intruded into ink-jet head 1 beyond the side cover plate 153, it hardly reaches the upper surface of the actuator unit 21 due to the COF 50. Therefore, it is prevented the individual electrodes 35 formed on the actuator unit 21 from being shorted out among themselves.

Figure 9B:
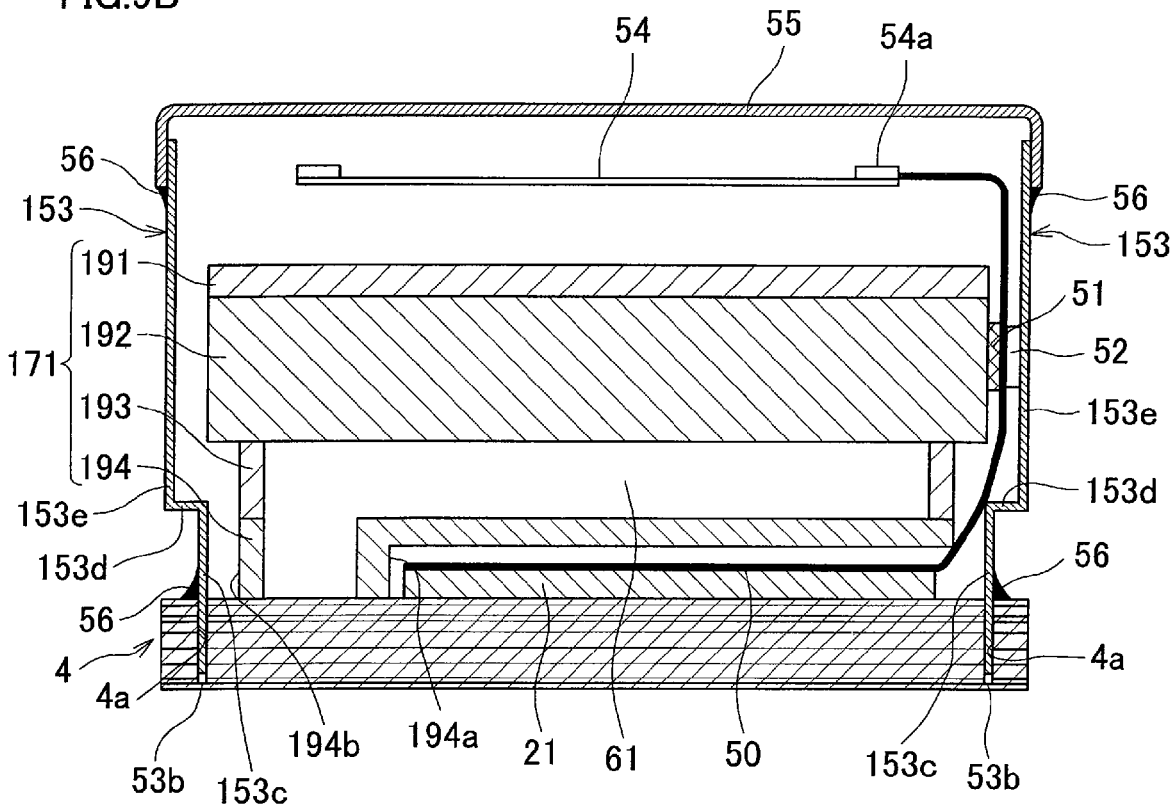
FIG. 9B is a schematic view showing an ink-jet head according to another modified embodiment, which is similar to FIG. 1.

In addition, in this modification, as shown in FIG. 9B, it may be constructed such that the corner between the first vertical wall 153*c* and the opposed wall 153*d* is positioned above the lower recess 194*a*, i.e., the upper end of the opening of the gap between the passage unit 4 and the reservoir unit 171 [a position farther from the passage unit 4]. In this case, the COF 50 that is disposed as to be bent serves to press against the actuator unit 21 using a restoring force thereof returning to its flat state. Thus, it is possible to maintain good electrical connection between them. Further, in this case, the widths of the reservoir plate 193 and the under plate 194 come to be smaller than those of the upper plate 191 and the filter plate 192. Thus, the reservoir unit 171 does not come into contact with the first vertical wall 153*c*.

In addition, it may be constructed such that the COF 50 comes into contact with either the above-mentioned corner between the first vertical wall 153*c* and the opposed wall 153*d*, or the corner of the under plate 194. Otherwise, it may be constructed such that the COF 50 comes into contact with neither the corner between the first vertical wall 153*c* and the opposed wall 153*d* nor the corner of the under plate 194. In addition the opposed wall 153*d* may not be disposed parallel to the upper surface of the passage unit 4.

While the above-disclosed embodiment is constructed such that through-holes are formed in the eight plates 22 to 29 except the nozzle plate 30 to thereby form the groove 4*a*, it may be constructed such that among the eight plates 22 to 29, one or more plates above any one of the plates 23 to 29 are provided with a through-holes for forming the grooves.

While the above-disclosed embodiment is constructed such that total eight grooves 4*a* are provided at both lateral ends of the passage unit 4 by four grooves, respectively, the present invention is not limited thereto, but may be constructed such that total two or more grooves are provided at both lateral ends of the passage unit by one or more grooves, respectively.

In addition, while the above-disclosed embodiment is constructed such that the side cover plates 53 also serve as a heat sink for discharging heat of the driver IC chip 52, it may be constructed to provide another heat sink.

In addition, while the above-disclosed embodiment is constructed such that the side cover plates 53, and the projections 53*b* and the grooves 4*a* have the substantially equal lengths with respect to the lateral direction of the passage unit 4, it may be constructed such that the lengths of the grooves 4*a* and the projections 53*b* are shorter than that of the side cover plates 53 with respect to the lateral direction of the passage unit 4.

Further, it may be constructed such that the lengths of the grooves 4*a* is longer than those of the side cover plates 53 and the projections 53*b* with respect to the lateral direction of the passage unit 4. In this case, although gaps are defined between the grooves 4*a* and the side cover plates 53, similar to the embodiment, by applying the sealing member 56 thereto there is no case where ink is intruded into the ink-jet head from the gap. In addition, even though the gaps are not sealed by the sealing member 56, it is sufficiently prevented ink from being intruded into the ink-jet head. Because ink is introduced only in the case that it is introduced from the outer gap between the grooves 4*a* and the side cover plates 53 to flow downward to the bottom of the grooves 4*a* and further upward up to the inner gaps between the grooves 4*a* and the side cover plates 53.

In addition while the above-disclosed embodiment is constructed such that the sealing member 56 is applied to extend across the outer side of the side cover plates 53 and the upper surface of the passage unit 4, it may be constructed such that the sealing member 56 is not applied. In this case, since the contact lines 53*a* and the upper surface of the passage unit 4 come into contact with each other, it is prevented ink from being intruded into the ink-jet head. In addition, since the projections 53*b* is formed adjacent to the contact lines 53*a*, and is fitted into the grooves 4*a* , even though there are gaps between the projections 53*b* and the grooves 4*a*, it is sufficiently prevented ink from being introduced into the ink-jet head. Because ink is introduced only in the case that it is introduced from the outer gaps between the projections 53*b* and the grooves 4*a* to flow to the bottom of the grooves 4*a* and further up to the inner gaps between the projections 53*b* and the grooves 4*a*.

Figure 10:
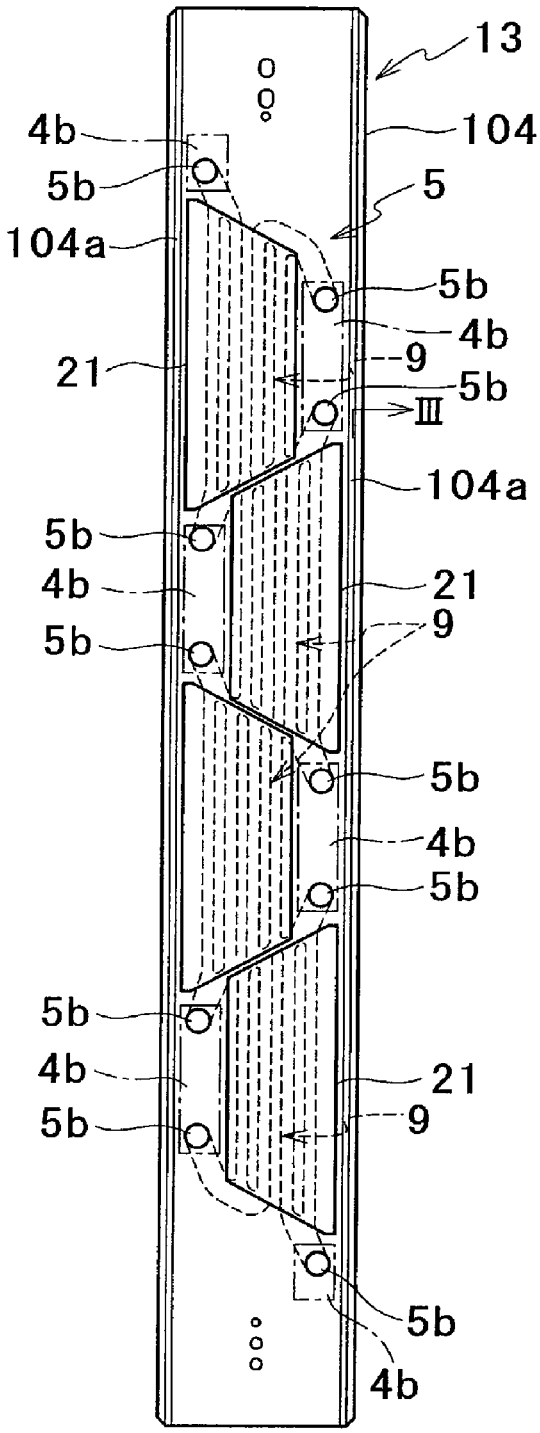
FIG. 10 is a plan view showing another embodiment of the invention, which is similar to FIG. 2.

In addition, the side cover plates may not be provided with the projections. In this case, as shown in FIG. 10, on the upper surface of the passage unit 4, two grooves 104*a* are formed near both lateral ends of the passage unit such that they extend across the passage unit in the longitudinal direction thereof by the same length of the side cover plate, and the lower ends of the side cover plates are fitted into the two grooves 104*a*. Since the side cover plates and the passage unit 104 come into contact with each other, it is prevented ink from being introduced into the ink-jet head. Of course, it is preferable that the sealing member 56 be applied, which more securely prevents ink from being introduced into the ink-jet head.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit having a pressure chamber communicating with an ink ejection port formed on an ink ejection face, a common ink chamber communicating with the pressure chamber, and an ink supply port formed on a surface opposite to the ink ejection face;

a reservoir unit having an ink reservoir communicating with the ink supply port at the surface of the passage unit where the ink supply port is formed, and storing ink supplied to the common ink chamber;

an actuator unit fixed to the passage unit and providing ink in the pressure chamber with a pressure;

a wiring member mounting thereon a driver IC chip that supplies a drive signal to the actuator unit, and connected to the actuator unit; and two shield plates extend on the surface of the passage unit in a longitudinal direction of the passage unit, and confront each other, wherein the surface of the passage unit is provided with two grooves extending in a thickness direction of the passage unit, and spaced to a distance equal to a distance between the two shield plates with respect to a lateral direction of the passage unit, wherein the shield plate is provided at its circumference with a contact line linearly extending and coming into contact with a plane formed on the surface of the passage unit, wherein the shield plate is provided with a projection adjacent to the contact line and protruding from the contact line, wherein the projection is fitted into the groove, and wherein the reservoir unit, the actuator unit, and the wiring member are included in a range maintained between the two shield plates, with respect to the lateral direction of the passage unit.

2. The ink-jet head according to claim 1, wherein the passage unit is provided with the plurality of grooves arranged in two rows in the longitudinal direction thereof, wherein the shield plate is provided at its circumference with the plurality of contact lines, wherein the shield plate is provided with the plurality of projections between the plurality of contact lines, and wherein the plurality of grooves and the plurality of projections are respectively fitted each other.

3. The ink-jet head according to claim 1, wherein the distance between the two shield plates is equal to or smaller than a width of the surface of the passage unit, and a width of the reservoir unit is smaller than the distance between the two shield plates.

4. The ink-jet head according to claim 1, wherein the surface of the passage unit is provided with a plurality of disposal regions for the ink supply port alternately provided near both lateral ends of the passage unit along the longitudinal direction thereof, and a plurality of disposal regions for the groove provided near both lateral ends of the passage unit opposite to the disposal region for the ink supply port with respect to the lateral direction of the passage unit, and wherein one or more ink supply ports are formed in the disposal region for the ink supply port, and one or more grooves are formed in the disposal region for the groove.

5. The ink-jet head according to claim 4, wherein the plurality of disposal regions for the ink supply port and the plurality of disposal region for the groove are arranged in zigzags along the longitudinal direction of the passage unit, and wherein with respect to the lateral direction of the passage unit, the groove, the side face of the reservoir unit, and the ink supply port are serially disposed from outside such that they are spaced to a distance each other.

6. The ink-jet head according to claim 1, wherein the passage unit has a structure in which a plurality of plates including a nozzle plate where the ink ejection face is formed are laminated, and wherein the groove extends in a thickness direction of the passage unit from the surface of the passage unit to a surface of the nozzle plate opposite to the ink ejection surface.

7. The ink-jet head according to claim 1, wherein the shield plate includes a first vertical wall extending opposite to the projection from the contact line, an opposed wall extending from an end of the first vertical wall opposite to the projection toward an outer lateral end of the passage unit, and confronting the surface of the passage unit, and a second vertical wall extending from the outer lateral end of the passage unit in a direction away from the passage unit.

8. The ink-jet head according to claim 7, wherein a corner connecting the first vertical wall and the opposed wall of the shield plate each other is positioned farther from the surface of the passage unit than a position where the wiring member and the actuator unit are connected and the wiring member is in contact with the corner.

9. The ink-jet head according to claim 8, wherein the reservoir unit is piled up on the passage unit such that a gap is defined between the reservoir unit and the passage unit, the gap having an opening at the lateral end of the passage unit, wherein the actuator unit is fixed to the passage unit in the gap, and wherein the wiring member comes into contact with a part of the reservoir unit that partially defines the opening.

10. The ink-jet head according to claim 1, wherein onto an area where the surface of the passage unit and the contact line of the shield plate are in contact with each other, a sealing member is applied to extend across the outer lateral side of the shield plate and the surface.

11. The ink-jet head according to claim 1, wherein the shield plate is composed of metal, and the shield plate and the driver IC chip are thermally coupled.

12. An ink-jet head comprising:

a passage unit having a pressure chamber communicating with an ink ejection port formed on an ink ejection face, a common ink chamber communicating with the pressure chamber, and an ink supply port formed on opposite surface to the ink ejection face;

a reservoir unit having an ink reservoir communicating with the ink supply port at the surface of the passage unit where the ink supply port is formed, and storing ink supplied to the common ink chamber;

an actuator unit fixed to the passage unit and providing ink in the pressure chamber with a pressure;

a wiring member mounting thereon a driver IC chip that supplies a drive signal to the actuator unit, and connected to the actuator unit; and two shield plates extend on the surface of the passage unit in a longitudinal direction of the passage unit, and confront each other, wherein the surface of the passage unit is provided with two grooves extending in the longitudinal direction of the passage unit by the same length of the two shield plates with respect to the longitudinal direction of the passage unit, extending in a thickness direction of the passage unit, and spaced to a distance equal to a distance between the two shield plates, wherein the shield plate is fitted into the groove, and wherein the reservoir unit, the actuator unit, and the wiring member are included in a range maintained between the two shield plates, with respect to the lateral direction of the passage unit.

* * * * *